US005487797A

United States Patent [19]

Dumas et al.

[11] Patent Number: 5,487,797

[45] Date of Patent: Jan. 30, 1996

[54] PROCESS FOR THE MANUFACTURE OF A FLAT PRODUCT OF ZIRCONOUM ALLOY OR HAFNIUM ALLOY COMPRISING A CONTINUATION OF HOT ROLLING AFTER INFRARED REHEATING, AND ITS UTILIZATIONS

[75] Inventors: Gerard Dumas, Albertville; Pierre Barberis, Ugine; Gerard Bunel, Echauffour, all of France

[73] Assignee: Cezus Compagnie Europeenne du Zirconium, Courbevoie, France

[21] Appl. No.: 398,006

[22] Filed: Mar. 2, 1995

[30] Foreign Application Priority Data

Mar. 2, 1994 [FR] France ..... 94 02613

[51] Int. Cl.[6] ..... C22F 1/18

[52] U.S. Cl. ..... 148/672; 148/668; 148/565

[58] Field of Search ..... 148/672, 668, 148/565

[56] References Cited

U.S. PATENT DOCUMENTS

| | | | |
|---|---|---|---|
| 4,775,428 | 10/1988 | Bunel et al. | 420/422 |
| 4,881,992 | 11/1989 | Bunel et al. | 148/421 |
| 4,981,527 | 1/1991 | Charquet | 148/421 |
| 5,223,055 | 6/1993 | Charquet et al. | 148/672 |
| 5,256,216 | 10/1993 | Bunel et al. | 148/566 |

FOREIGN PATENT DOCUMENTS

| | | | |
|---|---|---|---|
| 2303865 | 3/1976 | France . | |
| 57-188660 | 11/1982 | Japan . | |
| 6-49608 | 2/1994 | Japan | 148/672 |
| 1537930 | 1/1979 | United Kingdom . | |

*Primary Examiner*—John Sheehan

*Attorney, Agent, or Firm*—Dennison, Meserole, Pollack & Scheiner

[57] ABSTRACT

A process for the manufacture of a sheet, band or strip of zirconium alloy or hafnium alloy, comprising hot roughing of an ingot into a blank, then hot rolling of this blank in the alpha domain, this hot rolling including several passes which follow one or more reheatings in a furnace at one or more temperatures (TR), each of which improves the formability of this blank, then cold rolling which consists of one or more cycles of rolling pinch passing/heat treatment. The hot rolling pass following the last furnace reheating is followed by reheating of the hot rolled blank by at least 100° C. at more than 4° C./s by infrared heating means with a wavelength between 0.8 and 5 micrometers. The hot rolling is then continued until the thickness at the end of the hot rolling is less than or equal to 0.8 times the thickness of the hot rolled blank. The product obtained is used for the manufacture of zirconium or hafnium alloy parts for water-type nuclear reactors.

14 Claims, 2 Drawing Sheets

PROCESS FOR THE MANUFACTURE OF A FLAT PRODUCT OF ZIRCONOUM ALLOY OR HAFNIUM ALLOY COMPRISING A CONTINUATION OF HOT ROLLING AFTER INFRARED REHEATING, AND ITS UTILIZATIONS

BACKGROUND OF THE INVENTION

The present invention relates to a process for the manufacture of a sheet, band, or strip of zirconium alloy or hafnium alloy which comprises hot roughing of an ingot into a blank, followed by hot rolling of this blank in the alpha domain, this hot rolling including several passes which follow one or more reheatings in a furnace at one or more temperatures, each of which improves the formability of the blank, then cold rolling which includes one or more cycles of "rolling pinch passing/heat treatment".

A process of this type is known from the Applicant's patent FR-B-2599049 corresponding to EP-B-0246986 and U.S. Pat. Nos. 4,775,428 and 4,881,992. This patent discloses the manufacture by rolling of a 0.43 mm strip of Zircaloy 4 from a hot rolled band with a thickness of 6 mm. In the cold rolling of this strip, there are five cold rolling sequences with intermediate annealings, and each sequence actually consists of several cold rolling passes. The choice to stop the hot rolling at 6 mm is dictated by quality considerations, but the obvious disadvantage is the long duration of the manufacturing process and its cost.

On the other hand, in a process known from FR-A-2303865 corresponding to GB-A-1537930, a sheet of zirconium alloy for use in a nuclear reactor, for example of Zircaloy 4 with a thickness of 4 mm, is reheated up to at least 900° C. by means of high-frequency induction. The reheating of the sheet is superficial. The use of a lower frequency makes it possible to reheat the entire thickness of the sheet, but with substantial temperature gradients and deformations during the rapid cooling which follows this reheating. The only reheating temperature given as an example is 900° C., which corresponds to the alpha+beta domain in the case of Zircaloy 2 or 4.

Applicants have attempted to find a more economical way to handle the hot rolling while preserving or even improving the quality of the products obtained.

SUMMARY OF THE INVENTION

The object of the invention is an improvement of the process disclosed in FR-B-2599049, characterized in that the hot rolling pass following the last furnace reheating is followed by reheating of the hot rolled blank by at least 100° C. at more than 4° C./s by infrared reheating means with a wave length between 0.8 and 5 micrometers, and that the hot rolling is then continued until the thickness at the end of the hot rolling is less than or equal to 0.8 times the thickness of this hot rolled blank.

The study of prior rolling conditions indicated a physical obstacle which prevented reheating in order to continue the hot rolling, an obstacle linked to the size of the products. For example, a band of zirconium with a width of 550 to 600 mm, a length of about 6 meters, and a thickness of 6 mm, weighs 130 to 140 kilograms. In addition to the difficulty in transporting a hot band to and from a reheating furnace without excessive cooling, there are also substantial metallurgical disadvantages when one attempts to continue the rolling, since deformability decreases quite rapidly with the temperature and becomes insufficient below 500° C.

The use of infrared radiation for reheating at this stage, typically in order to regain a temperature between 550 and 700° C. in a band of zirconium alloy or a temperature between 800° and 1000° C. in a band of hafnium alloy, has two very major advantages: The infrared heating equipment is compact and can be placed in proximity to the rolling cylinders, and the infrared heating can be very rapid, heating the zirconium or hafnium alloy at more than 4° C./s and preferably at more than 5° C./s, which produces, for example, a temperature difference of 150° to 250° C. and a reheating time of less than 1 minute. The band of Zr or Hf alloy, being on its normal course, can be hot rolled again immediately, and during the rolling, when the passes are satisfactory, the temperature rises slowly so that it is possible to have, for example, three or four passes which lead to a thickness at the end of the hot rolling which is less than 0.8 times the thickness of the hot rolled, infrared reheated blank, and which reaches 0.4 to 0.6 times this thickness with several infrared reheatings.

In fact, for bands of Zr or Hf alloy it is often preferred to effect one or more intermediate infrared reheatings during the continuation of the hot rollings, particularly when the thickness is reduced to attain in the end 0.4 to 0.6 times the thickness of the hot rolled blank which has undergone the first infrared reheating. The rapidity of the infrared reheatings, for example more than 50° C. in ten seconds, compensates remarkably for the rapidity of the cooling of the band, which increases greatly with each reduction in its thickness.

As will be seen further on, the infrared reheating of the invention allows proper control of the temperature differences in the blank, so that it avoids the disadvantages known for example in the practice of heating by induction, that is in the case of FR-A-2303865. Thus, infrared heating, which is otherwise known, furnishes remarkable advantages when it is used according to the invention for zirconium or hafnium alloy products specifically intended for nuclear uses.

In order to effect the reheating with infrared heating means, it is possible to position them either movably, in procession above the blank emerging from the hot rolling pass following the last furnace reheating, or statically, so that the handling means causes no more than 30 seconds of idle time between the reheating and the hot rolling passage which follows it. In effect, as has already been indicated, it is possible to maintain the temperature during the hot rolling through internal friction of the products being formed, but at this level of thickness, as soon as the rolling stops there is a rapid cooling which gives rise to the difficulties already indicated or which makes it impossible to continue the rolling.

After the infrared reheating, the rolled blank typically has a thickness between 5 and 8 mm, a width between 250 and 600 mm, and a length of several meters, for example from 3 to 8 m.

In all of the preceding, it has been noted that given manufacturing conditions which do not destroy the thermal oxide coating of a hot rolled band or blank, this thermal oxide coating, whether of zirconium or hafnium, facilitates the speed of the infrared heating of the band when it has a thickness between 1 and 20 micrometers, which can be obtained by hot transformation, and which does not abrade the surfaces of the band. The infrared reheating(s) can thus be effected at more than 6° C./s without difficulty.

With infrared reheating, the blank or the band is reheated with temperature differences across its thickness of less than 10° C. and temperature differences across its width of less than 7° C. per 100 mm of width. The crosswise temperature differences can be reduced by a factor from 1.5 to 3 by effecting the reheating(s) using infrared tubes disposed along the longitudinal direction of the blank or band, with each tube being individually temperature controlled.

Zirconium and hafnium alloys are antagonists with regard to neutrons, but are twins metallurgically, except for a rather substantial difference in their transformation temperatures.

In the case of zirconium alloys, Applicants are particularly interested in Zircaloy 2 and Zircaloy 4 alloys. The compositions of these Zircaloy 2 and Zircaloy 4 alloys are given in ASTM specifications B 352-85, in which these alloys correspond respectively to grades R 60804 and R 60802. Applicants are also interested in the same alloys modified by reducing the Sn content to a minimum of 0.5%, in the Zr-Fe-V alloy described in the Applicants'patent FR-B-2624136 corresponding to U.S. Pat. No. 4,981,527, as well as in Zr-Nb alloys which contain up to 3% Nb, such as the alloy which corresponds to grade R 60 901 in ASTM specification B 352-85.

A typical condition for the zirconium alloys is that in which the sheet or band has a furnace reheating temperature (TR) between 600° and 800° C., with the rolled blank, before its infrared reheating, still having a temperature between 350° and 500° C. and being brought by this infrared reheating to a temperature between 550° and 700° C.

The hafnium alloys in which Applicants are interested are specifically alloys which contain 0.5 to 6% zirconium and more precisely, alloys of the Hf type with 1% Zr and Fe at less than 500 ppm and of the Hf type with Fe at less than 500 ppm and Zr at less than 4.5% by weight.

In the case in which the sheet, band or strip is of hafnium alloy, this alloy comprising at least 90% hafnium by weight, the furnace reheating temperature (TR) is typically between 850° and 1000° C. and the rolled blank, before its infrared reheating, has a temperature between 600° and 800° C. and is brought by the infrared reheating to a temperature between 800° and 1000° C. for the continuation of the hot rolling.

With the above modalities, the typical thicknesses at the end of hot rolling are less than 4 mm and greater than or equal to 2 mm for zirconium alloys, and between 2 and 5 mm for hafnium alloys.

In all of the preceding, for the practical execution of the hot rolling, the infrared reheating of the rolled blank is preferably effected between an assembly of infrared tubes which radiate one side of the blank and one or more white refractories which face the reverse side of the blank and which are situated at least 30 mm from the reverse side.

It is more effective to dispose an assembly of infrared tubes on each side of the band, but it is not always economical or practical.

In a rolling mill with a reversibly driven cylinder or cylinders, the band can advantageously and very simply be made to pass in front of an assembly of infrared tubes with each movement back and forth, as the reduction in the thickness of this band progresses.

The process described can be used in the manufacture of zirconium alloy mounting and spacing parts for pressurized water and boiling water nuclear reactors, in which case the cold rolling is executed until a thickness between 0.4 and 3.5 mm is achieved. The process can also used in the manufacture of neutron absorbing parts of an alloy of at least 90% hafnium, in which case the cold rolling is executed until a thickness between 0.5 and 3.5 mm is achieved.

The advantages of the invention are:

Easier attainment of a texture at T which facilitates good formability of the cold rolled zirconium alloy tubes (Applicants'patent, U.S. Pat. No. 5,223,055 corresponding to FR-A-2664907) by reducing the number of cold rolling cycles; and a savings in transformation costs by reducing the cold forming cycles, which is even more substantial in the case of hafnium.

DESCRIPTION OF THE PREFERRED EMBODIMENTS

1. Static reheating tests of a plate of Zircaloy 4.

Figure 1:
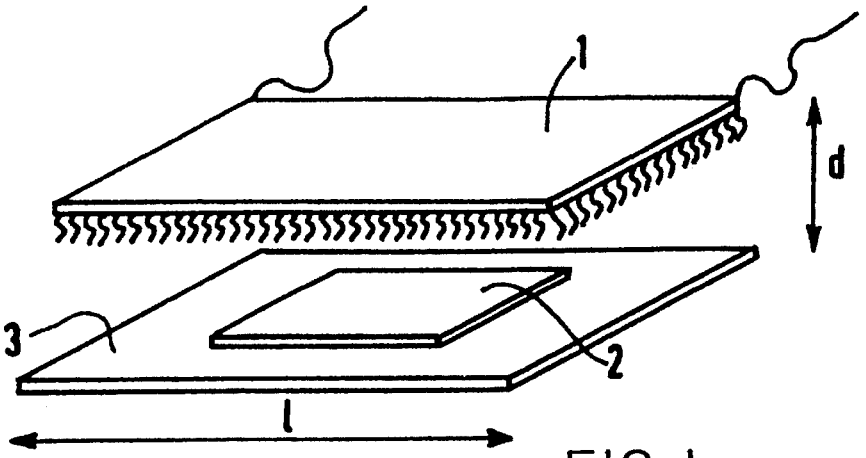
FIG. 1 is a plan view of an arrangement for static infrared heating of sheets of Zircaloy 4.

1.1 Installation (FIG. 1)

The installation shown if FIG. 1 includes "short" infrared tubes (wavelengths of 1 to 3 micrometers) with tungsten filaments brought to approximately 2100° C., alternating current supplied at 230 V, and an electrical power output of 3 Kw per tube.

Since the connections of the tubes must not exceed 350°, they are cooled by a substantial air flow of 13 $m^3$ per connection per hour. Tubes with water circulation can also be used.

The heating panel 1 includes 6 tubes, for a total power output of 18 Kw. It develops a power density P of approximately 180 $Kw/m^2$ at a distance d from sheet 2 of 40 mm, and 200 $Kw/m^2$ at d=20 mm.

The sheet 2 with a width of 250 mm is disposed at a distance d from the tubes on a bed 3 which projects beyond sheet 2 with a width 1 of 300 mm.

1.2 Static heating tests

This test studied the rate of heating of a 6 mm sheet and the temperature heterogeneities which would result from this heating, taking into account the relatively weak thermal conductivity of zirconium.

Figure 2:
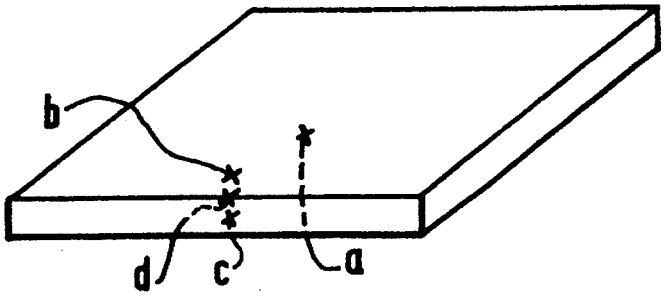
FIG. 2 shows schematically the location of the thermocouples in the static heating arrangement of FIG. 1.

The thermocouples were placed at different points of the sheet, specifically in the middle of this 250×250 mm sheet on its lower side, at 8 mm from the upper and lower edges, and at mid-thickness of the sheet. The temperature measurement at mid-thickness was taken through a bore into which the thermocouple was inserted. These reference points are shown, respectively, as a, b, c and d in FIG. 2.

The adjustment of the distance d from the infrared panel to the sheet and the influence of the quality of the refractory were initially studied. Moving from a 40 mm to a 20 mm distance between the sheet and the infrared panel caused a 40 to 60% increase in the rate of rise in the temperature of the sheet. In the tests, a distance of 20 mm was chosen. In addition, a white refractory reflects the largest portion of the thermal energy radiated by the lower side of the sheet, and in a constant infrared heating this white refractory in and of itself makes it possible to obtain a rate of rise in the temperature of the flat product that is 1.2 times higher than a dark colored refractory. Here again the best solution was chosen for the static heating test, that is, a light colored refractory.

In the static heating test proper, the following steps were carried out:

heating to nearly 500° C. then cooling to nearly 350° C., cooling being accelerated by the blowing of air on the radiating panel 1, then a resumption of the heating up to 620 to 720° C. which simulates the reheating in the course of hot rolling which is the object of the invention.

Figure 3:
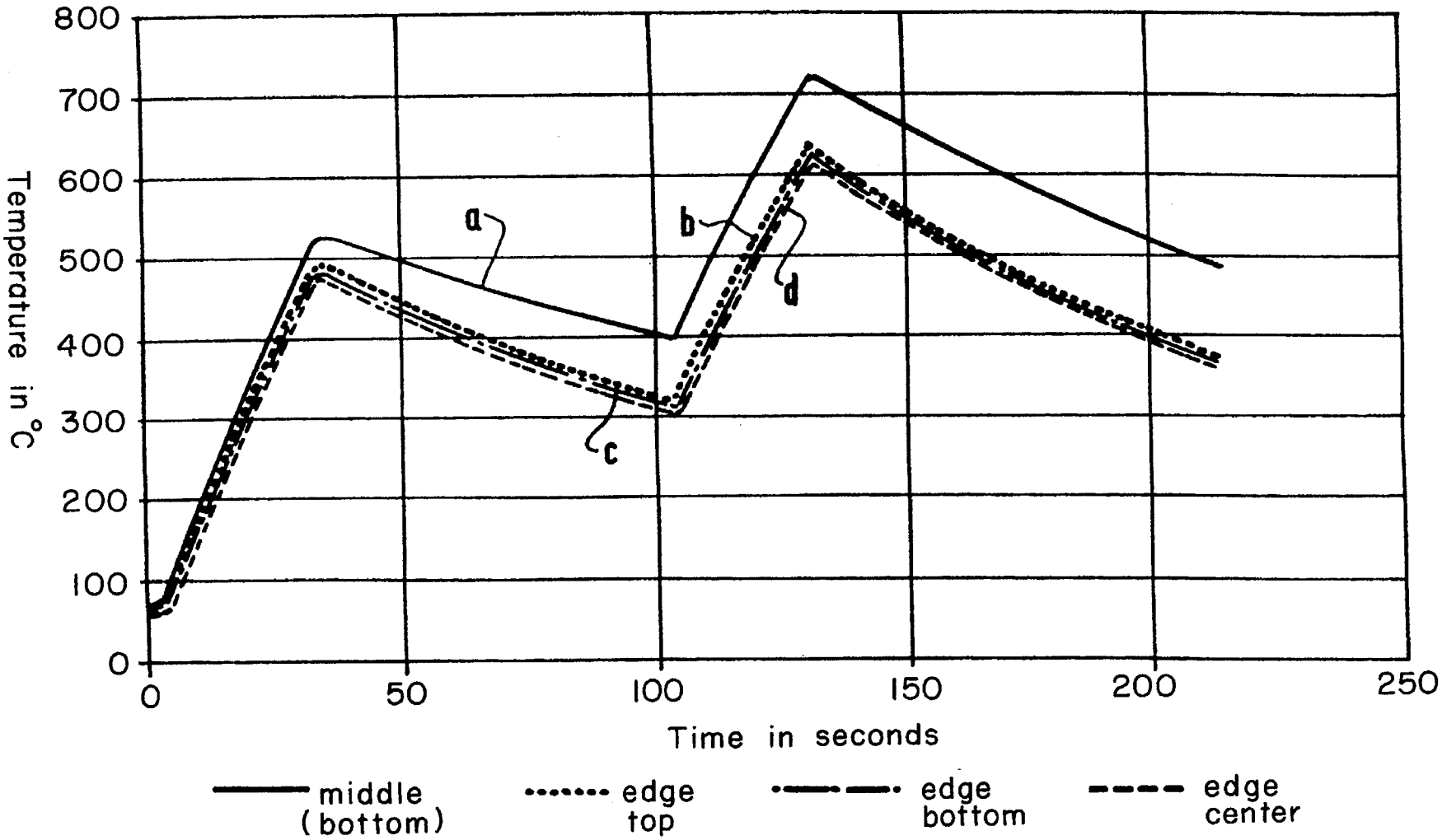
FIG. 3 is a graph of temperatures vs. time in static heating tests conducted with the arrangement of FIG. 1.

The results obtained at the different temperature measurement points appear in the diagram in FIG. 3, and the curves of the temperature measurements b, c, d taken previously next to one edge of the sheet are practically indistinguishable, being within nearly 5° of one another.

It is noted that with regard to the step of reheating between approximately 350° C. and 650° C., everything occurs as though there were two separate tests. In fact, during the initial heating, the edge of the sheet experiences a temperature lag in comparison with the middle, and this lag increases during the cooling which follows, then remains constant during the next reheating. What is important is the fact that the rise in the temperature of the edge is parallel to the rise in the temperature of the middle, which clearly shows that the infrared reheating does not cause significant variations in transverse temperature. It is also important to note that the rate of the rise in the temperature is increased by an average of 300° C. in 30 s, with a temperature which will remain homogeneous in an actual situation in which there is no substantial temperature variation from one point of the sheet to another.

It is also important to note that the adequate disposition of the infrared reheating means and their individual control makes it possible to eliminate the temperature differences between the edge and the center of the sheet.

The rate of the natural cooling which follows the reheating to approximately 650° C. (between 620° and 720° C. on the various curves) can also be seen in FIG. 3. This rate is considerable and it clearly shows the importance of executing the treatments and rollings without wasting any time between the successive steps. It also makes it understood that any handling of the hot rolled sheet in order to return it to a remote reheating furnace in the plant would cause a situation in which the resumed hot rolling would be more or less uncontrollable due to the cooling rate of the reheated sheet.

In the course of the tests, a very low inertia of the reheating device was measured. The infrared panel attains its operating conditions in only a few tenths of a second; likewise, when the power supply to this panel 1 is cut once the desired reheating temperature has been exceeded, the panel cools very rapidly. This low inertia provides great flexibility in the control of the system and fast response to a control system, as will be shown in FIG. 4.

2. An arrangement for reheating during hot rolling

Figure 4:
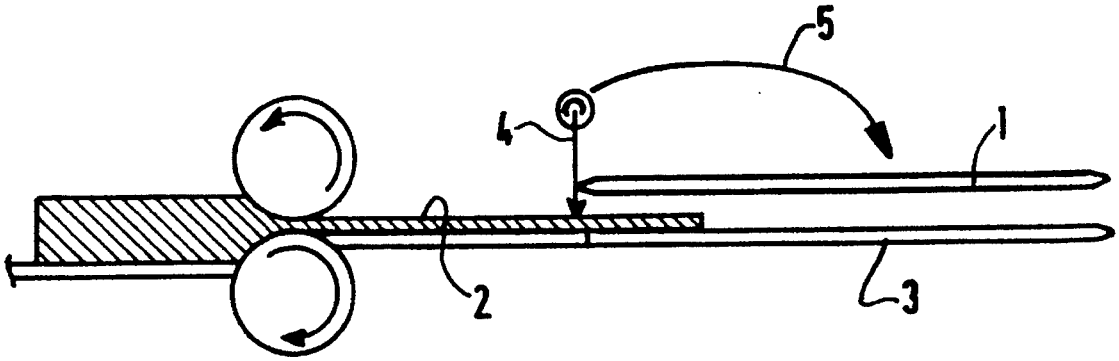
FIG. 4 is a schematic cross-sectional view of a practical arrangement for reheating a sheet of Zircaloy 4 in the course of cold rolling.

In the installation shown in FIG. 4, the hot rolled sheet 2 has just undergone a final pass which has brought it to a thickness of 6 mm, and this sheet 2 is no longer capable of being reheated by conventional means due to its long length and the layout of the plant.

The sheet 2, which has a thickness of 6 mm and which is still between 530° and 500° C., passes directly upon emerging from the hot rolling under an infrared panel 1 and over a white refractory 3. A temperature measurement 4 of the hot rolled sheet is taken at the moment at which it is inserted under the infrared panel, and this temperature measurement 4, which simultaneously indicates the passage of the sheet, is used to control the operation of the infrared panel and the heating power of this panel with control means 5. After this reheating, the reheated sheet is inserted into a new rolling pass, for which the cylinders are situated at least 2 meters and 10 to 15 s away from the exit side of the infrared panel.

3. An example of a utilization of the infrared reheating according to the invention.

FR-B-2599049 (U.S. Pat. No. 4881992) cited above gives a rolling sequence for a strip with a thickness of 0.43 mm, which is as follows:

hot rolling +6 mm thickness static flat annealing for 3 to 4 hours at 650°/700° C., then the following cold rolling (CR) sequences:

a first CR to a thickness of 3.5 mm, then annealing in procession for 3 to 4 minutes at 650°/700° C., then a second CR to a thickness of 1.85 mm, annealing in procession for 3 min at 700° C., then a third CR to a thickness of 1.45 mm, annealing in procession for 3 min at 700° C., then a fourth CR to a thickness of 0.75 mm, annealing for 2.5 min at 700° C. in procession a little faster than before, a fifth CR to a thickness of 0.43 mm, then a final heat treatment in argon.

These steps are modified according to the invention by providing, after the hot rolling to 6 mm, in succession, an infrared reheating to 680° C., then a continuation of the hot rolling in several passes with intermediate infrared reheatings, to a thickness of 2.7 mm. Then there is an annealing in procession, then a first CR to a thickness of 1.45 mm followed by an annealing, then a second CR to a thickness of 0.75 mm which is also followed by an annealing in procession, then a final CR to a thickness of 0.43 mm followed by either an annealing or a quenching; this quenching from the beta domain can also substitute for the preceding annealing.

The quenching in the beta domain can be the object of an infrared reheating in the beta domain, which is particularly advantageous because of the homogeneity of temperature obtained.

It can be seen that the simplification brought about by the invention is considerable; two cold rolling/annealing cycles have been eliminated and an improvement in the homogeneity of thicknesses and structures is obtained.

What is claimed is:

1. In a process for manufacturing a sheet, band or strip of zirconium alloy or hafnium alloy comprising the steps of:

hot roughing an ingot into a blank;

hot rolling the blank in the alpha temperature range comprising a plurality of hot rolling passes and at least one reheating in a furnace between said hot rolling passes, and including at least an initial hot rolling pass and a final hot rolling pass following a furnace reheating, to form a hot rolled blank of predetermined thickness; and cold rolling the hot rolled blank including at least one cycle of rolling pinch passing followed by heat treatment;

the improvement comprising subjecting the hot rolled blank, before said cold rolling, to infrared reheating with a wave length between 0.8 and 5 micrometers, to increase the temperature of the hot rolled blank by at least 100° C. at a rate of at least 4° C./s, and continuing hot rolling until the blank has a thickness less than or equal to 0.8 times said predetermined thickness, said continuing including a plurality of hot rolling passes with at least one infrared reheating therebetween.

2. The process according to claim 1, wherein said reheating of the hot rolled blank is accomplished with infrared heating means movably mounted above the hot rolled blank emerging from said final hot rolling pass.

3. The process according to claim 1, wherein said blank, after said continuing hot rolling, has a thickness of between 5 and 8 mm, a width of between 250 and 650 mm and a length of several meters.

4. The process according claim 1, wherein said hot rolled blank includes, before infrared reheating, a thermal oxide coating of oxide of Zr or Hf with a thickness between 1 and 20 micrometers, said infrared reheating being effected at more than 5° C./s.

5. The process according to claim 1, wherein said hot rolled blank is infrared reheated with temperature differences across its thickness of less than 10° C., and temperature differences across its width of less than 7° C. per 100 mm of width.

6. The process according to claim 1, wherein said infrared reheating of the hot rolled blank is effected by disposing infrared tubes longitudinally along said hot rolled blank, and individually controlling each said tube.

7. The process according to claim 3, wherein the alloy is a zirconium alloy, said reheating in a furnace takes place at a temperature of between 600° and 800° C., the hot rolled blank has a temperature between 350° and 500° C. and said infrared reheating brings the hot rolled blank to a temperature between 550° and 700° C.

8. The process according to claim 3, wherein the alloy is a hafnium alloy including at least 90% hafnium by weight, said reheating in a furnace takes place at a temperature between 850° and 1000° C., the hot rolled blank has a temperature between 600° and 800° C. and said infrared reheating brings the hot rolled blank to a temperature between 800° and 1000° C.

9. The process according to claim 7, wherein said hot rolled blank, after said continuing hot rolling, has a thickness less than 4 mm and greater than or equal to 2 mm.

10. The process according to claim 8, wherein said hot rolled blank, after said continuing hot rolling, has a thickness between 2 and 5 mm.

11. The process according to claim 1, wherein said infrared reheating of the hot rolled blank is effected by disposing the hot rolled blank between an assembly of infrared tubes which radiate one face of the blank and one or more white refractories facing an opposite face of said hot rolled blank and situated at least 30 mm away from the opposite face.

12. The process according to claim 1, wherein said infrared reheating is effected by disposing said blank between two assemblies of infrared tubes.

13. The process according to claim 1, wherein the alloy is a zirconium alloy, and the sheet, band or strip is subsequently used in the manufacture of zirconium alloy mounting or spacing parts for pressurized water and boiling water nuclear reactors, wherein said cold rolling is executed until a thickness between 0.4 and 3.5 mm is achieved.

14. The process according to claim 1, wherein the alloy is a hafnium alloy containing at least 90% by weight hafnium, and the sheet, band or strip is subsequently used in the manufacture of neutron absorbing parts, wherein said cold rolling is performed until a thickness between 0.5 and 3.5 mm is achieved.

* * * * *